US006021297A

United States Patent [19]

Campbell et al.

[11] Patent Number: 6,021,297

[45] Date of Patent: Feb. 1, 2000

[54] FLEXIBLE DOCTOR BLADE HAVING A RADIUSED CONTACT SURFACE

[75] Inventors: Alan Stirling Campbell; Christina Allison Cullins; Kermit Arnold Meece; Peter Eric Wallin, all of Lexington, Ky.

[73] Assignee: Lexmark International, Inc., Lexington, Ky.

[21] Appl. No.: 09/198,696

[22] Filed: Nov. 24, 1998

[51] Int. Cl.[7] ..... G03G 15/08

[52] U.S. Cl. ..... 399/284

[58] Field of Search ..... 399/274, 284

[56] References Cited

U.S. PATENT DOCUMENTS

| | | | |
|---|---|---|---|
| 5,057,868 | 10/1991 | Sekino et al. | 399/284 |
| 5,191,170 | 3/1993 | Yoshida et al. | 399/284 |
| 5,237,375 | 8/1993 | Michlin et al. | 399/274 |
| 5,289,237 | 2/1994 | Hashizume et al. | 399/284 |
| 5,400,128 | 3/1995 | Michlin | 399/350 |
| 5,623,718 | 4/1997 | Bracken et al. | 399/284 |
| 5,702,812 | 12/1997 | Bracken et al. | 428/323 |
| 5,708,943 | 1/1998 | Applegate et al. | 399/284 |
| 5,722,022 | 2/1998 | Park | 399/284 |
| 5,797,076 | 8/1998 | Bracken et al. | 399/284 |

*Primary Examiner*—William Royer
*Assistant Examiner*—William A. Noē
*Attorney, Agent, or Firm*—John A. Brady

[57] ABSTRACT

A flexible doctor blade having a radiused surface or nub for contacting a developer roll. The blade geometry which includes a cantilevered support for the nub provides lower torque in the developer, compliance to compensate for developer imperfections, and less tendency for streaking due to toner packing and filming.

18 Claims, 2 Drawing Sheets

FLEXIBLE DOCTOR BLADE HAVING A RADIUSED CONTACT SURFACE

BACKGROUND OF THE INVENTION

The invention relates to doctor blades for metering electrophotographic toner held on a developer roller by physically contacting a sector of the roller with a surface of the blade. More particularly, the invention is directed to a flexible doctor blade having a radiused surface for contacting the developer roll surface instead of a conventional flat surface. A radiused nub extends from the blade body which allows the pressure needed in the doctoring nip to be achieved with a lower force between the blade and the developer roll.

In electrophotographic printers that use a developer roll to carry toner to the photoconductor, it is necessary to provide a means of metering the toner to produce a thin, uniform layer of toner on the developer. FIG. 1 shows a typical developer. Toner 1 is coated on the developer roll 2 by a toner adder roll 3. As the developer roll rotates it carries the toner to a doctor blade 4 which is pressed against the developer roll by a doctor blade spring 5. The pressure that is generated in the nip between the doctor blade and developer causes the formation of a layer of toner 6 that is then carried to the photoconductor 7 where the latent image is developed. The amount and uniformity, of toner that passes under the doctor blade is a function of, among other things, the pressure in the nip with higher pressures producing less mass per unit area. The torque needed to turn the developer roll is a function of the force of the doctor blade spring and the coefficient of friction between the doctor blade and developer roll.

The doctor blades used in the IBM/Lexmark 40×9 printer family all use a flat steel doctor blade and rubber or urethane developer rolls. These components are controlled to tight straightness and runout tolerances in order to control the uniformity of toner flow. The doctor blade force used is up to 1400 grams with the resulting frictional torque being more than half of the developer's required torque. The 40×7 laser printer uses a flat sandpaper blade with a foam backing and a load of 800 grams. (See U.S. Pat. Nos. 5,708,943; issued Jan. 13, 1998; 5,702,812; issued Dec. 30, 1997; and 5,623,718; issued Apr. 22, 1997, all assigned to the assignee of this invention.) The compliance of the foam backing reduces tolerances and costs of the components, but the frictional torque is still the primary source of torque in the developer. In order to extend the technology to higher speeds, it will be beneficial to reduce the developer heating that is caused by doctor blade friction.

Both the flat steel blade and flat sandpaper flex blade have shown problems when used with 8 micron toners. Toner becomes packed in the forward region of flat doctor blade shown in FIGS. 2A & 2B. The wedge of toner becomes compacted to the point that its cohesive strength and adhesion to the blade can produce a blockage of toner. This prevents toner from entering the nip and results in vertical white streaks in print.

One solution to the difficulties encountered was the use of a compliant doctor blade having a conductive metal bar with a lower surface to which a resilient layer is attached. The lower surface of the resilient layer has attached to it a stiff shim. The stiff shim has a bottom layer of conductive and abrasive material. At one end of the doctor blade a resilient conductive coating bridges the abrasive layer and the metal bar. If desired, the blade is at an angle with the surface of the developer roller—see U.S. Pat. No. 5,797,076, issued Aug. 18, 1998, assigned to the assignee of this invention.

A second solution to the problem was disclosed in U.S. Pat. Nos. 5,400,128 and 5,237,375, which were directed to wiper and spreader blades with conductive coatings. The wiper blade removed excess toner from the photosensitive drum and the spreader blade controls and adjusts the quantity of toner on the developing cylinder. Nowhere is there disclosed or suggested the novel doctor blade of the present invention.

It is an object of the present invention to provide a doctor blade for use in an electrophotographic process which consists of a radiused surface which lowers torque exerted by the developer roller.

It is a further object of the present invention to provide a doctor blade for use in an electrophotographic process which has a relatively small radius surface of a flexible conductive material to meter toner onto a developer roller.

Still, another objective of the present invention is to provide a doctor blade for use in an electrophotographic process which is less sensitive to developer roll and doctor blade tolerances.

Yet another objective of the present invention is to provide a doctor blade for use in an electrophotographic process which is less prone to toner streaking.

SUMMARY OF THE INVENTION

In accordance with the invention, a doctor blade for use in electrophotographic printing or copying processes is described which comprises a radiused surface or nub that contacts the developer roll. The radiused surface or nub is made of a wear resistant, conductive flexible material. The blade geometry provides lower torque in the developer roller, compliance to compensate for developer imperfections and less tendency for streaking due to toner packing and filming.

BRIEF DESCRIPTION OF THE DRAWINGS

This invention, together with other objects, features aspects and advantages thereof, will be more clearly understood from the following drawings.

DETAILED DESCRIPTION OF THE INVENTION

Figure 4:
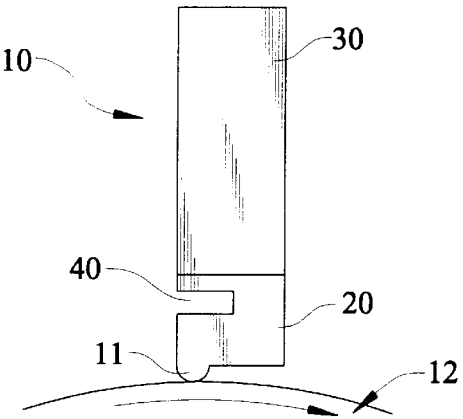
FIG. 4 is a cross-section of the doctor blade embodying the present invention.
Figure 3:
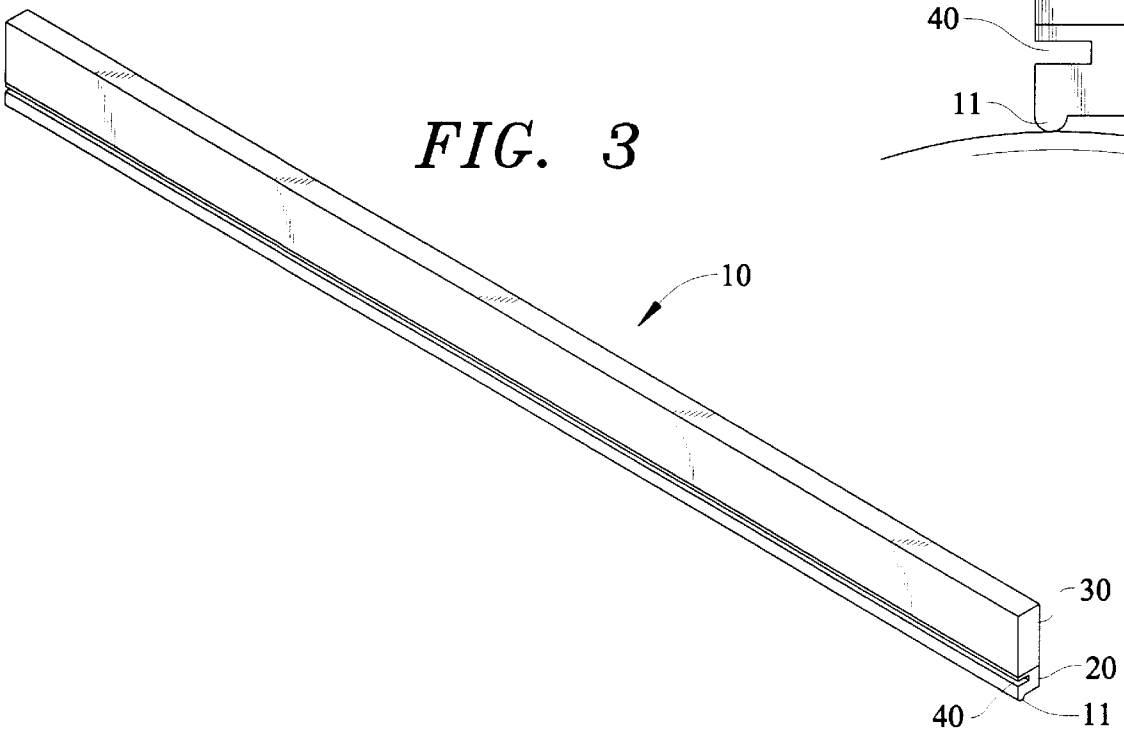
FIG. 3 is a perspective view of a doctor blade embodying the present invention.

The doctor blade 10 of this invention is used for electrophotography or copying and is depicted in FIGS. 3 and 4. The doctor blade 10 has a radiused surface or nub 11 that contacts the developer roll 12. The radiused surface 11 is preferably made of a wear resistant, conductive flexible material. The supporting structure 20 of the radiused surface 11 is preferably flexible and conductive.

The radius of the nub 11 can be measured with the nub having a cylindrical. elliptical or other rounded shape at its tip. The radius of the nub 11 is preferably less than the radius of the developer roll 12 and preferably less than about 20 mm.

A smaller radius achieves metering pressure with lower force, lower torque and less frictional heating. The smaller radius provides an exit path for toner in the pre-nip region, reduces charging of the developer roll and lowers doctor blade current.

A larger radius provides for more opportunity for toner charging and is less sensitive to defects in geometry of the blade.

Depending on the desired result, a radius is selected which provides a number of benefits during electrophotography. Selection of wear resistant, conductive, and flexible materials limit geometry changes to the blade during use when abraded by silicon carbide in toner and provide sufficient conducting to charge the toner.

Flexibility of the supporting structure limits the need for springs which load the doctor blade against the developer roll. The rigid portion 30 of the blade structure can be constructed of plastic as well as of metal.

FIGS. 3 and 4 showed a preferred embodiment. The nub 11 is a cylindrical shape with a radius of 0.5 mm. The nub 11 is constructed of urethane or polyurethane and, if desired, conductive additives are included. A particularly desired additive is lithium perchlorate. The nub material has inherent resistance to toner filming and does not wear due to its high cut and tear resistance. Polyurethanes are particularly desired for this component. Support for the nub 11 is provided by a urethane cantilever 20. preferably, made of the same material as the nub 11 and an aluminum bar 30. The aluminum bar can be replaced by rigid plastic material. The cantilever design of the support portion 20 provides adequate compliance for the blade. The opening 40 in a side of the support portion 20 can be shaped in any manner to secure the desired compliance, u-shaped, square, rounded, etc.

Figure 1:
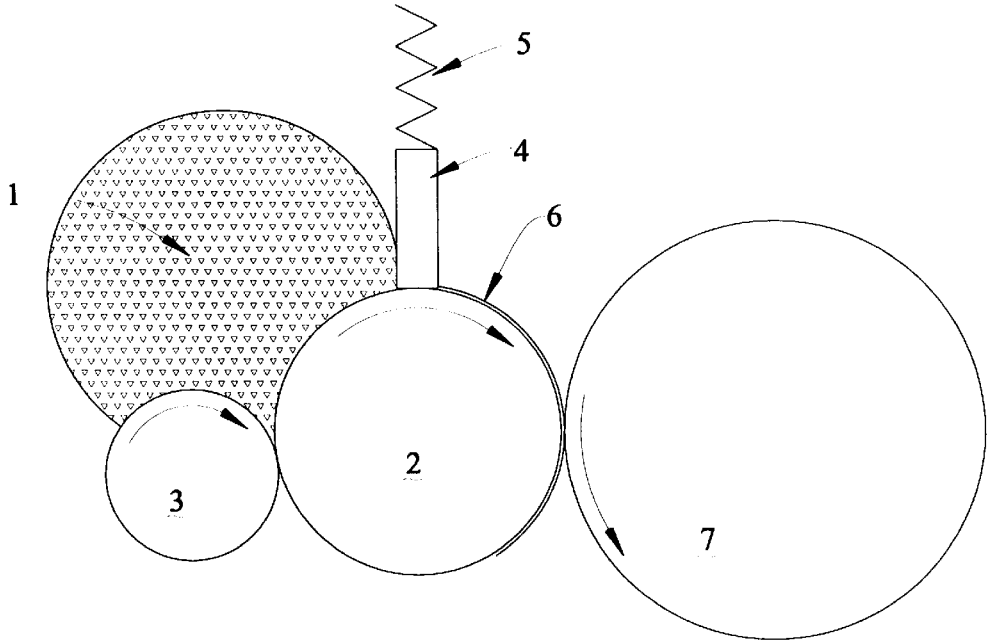
FIG. 1 (PRIOR ART)
FIG. 1 is a typical developer having a conventional doctor blade of the prior art.
Figure 2B:
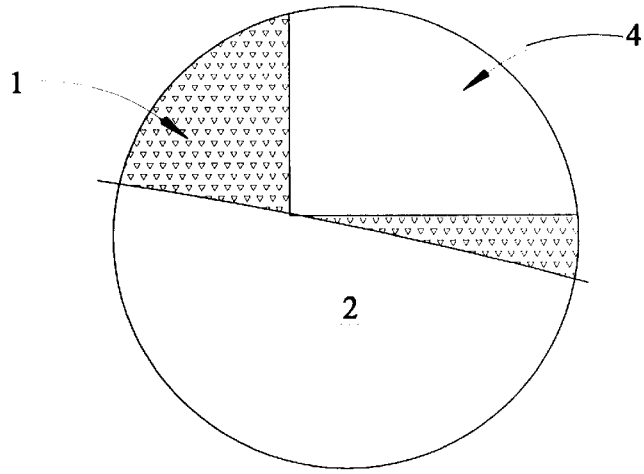
FIG. 2B (PRIOR ART)
FIG. 2B is an enlarged view of a flat doctor blade in the circled region of FIG. 2A of the prior art showing how toner builds up in the forward region of the blade.
Figure 2A:
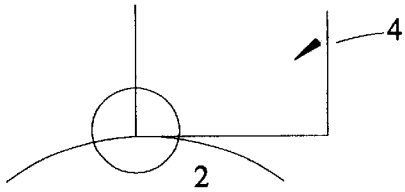
FIG. 2A (PRIOR ART)
FIG. 2A is a further view of the flat doctor blade in contact with the developer roll.
Figure 5:
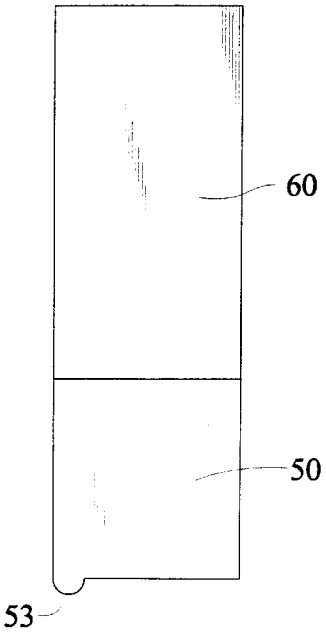
FIG. 5 is a cross-section of a doctor blade embodying an alternate structure of the present invention.

FIG. 5 depicts an alternate embodiment of the present invention wherein opening 40 (FIG. 4) is eliminated to provide a stiffer supporting structure 50, without a cantilever. The nub 53 is a cylindrical shape with a preferred radius of 0.5 mm. As in prior embodiments, conductive additives may be included. Support for the nub is provided by a urethane structure 50 and an aluminum bar 60. Any rigid material may be suitable for the bar 60.

The surface of the nub 11, 53 is critical to smooth metering of toner. The surface of the nub 11, 53, preferably has an average roughness (Ra) of less than 0.5 $\mu$m and must be free of any imperfections. The nub resistivity should not exceed $1\times10^{10}$ ohm cm., while nub material hardness shouldn't exceed 60 shore A.

The blade of the present invention can be used with seals in current printer cartridge designs. Its use has reduced torque produced by blade friction by almost 80% when compared to conventional steel blades.

Since minor changes and modifications varied to fit particular operating requirements and environments will be understood by those skilled in the art, the invention is not limited to the specific examples chosen for purposes of illustration, and includes all changes and modifications which do not constitute a departure from the spirit and scope of this invention as claimed in the following claims and reasonable equivalents to the claimed elements.

What is claimed is:

1. A doctor blade for metering electrophotographic toner held on a developer roll by physically contacting a sector of said roll with a surface of said blade which is electrically conductive, said blade comprising:

a supporting member having a bottom edge, said supporting member positioning said blade adjacent to said roll; and a resilient member having a top edge and a bottom edge, a nub extending from said resilient member bottom edge, said resilient member top edge attached to said supporting member bottom edge;

wherein said nub is electrically conductive and contacts said sector of said roll.

2. The doctor blade as claimed in claim 1, wherein said resilient member includes a resilient cantilevered member.

3. The doctor blade as claimed in claim 1, wherein said supporting member is aluminum or rigid plastic.

4. The doctor blade as claimed in claim 1, wherein said resilient member is made of polyurethane.

5. The doctor blade as claimed in claim 1, wherein said nub has a semi-cylindrical shape, or semi-elliptical shape.

6. The doctor blade as claimed in claim 5, wherein said nub has a semi-cylindrical shape with a radius less than a radius of said developer roll.

7. The doctor blade as claimed in claim 6, wherein said radius of said nub is less than 20 mm.

8. The doctor blade as claimed in claim 6, wherein said radius of said nub is 0.5 mm.

9. The doctor blade as claimed in claim 1, wherein said nub is made of polyurethane.

10. The doctor blade as claimed in claim 4, wherein said resilient member has one or more conductive additives, one of said conductive additives being lithium perchlorate.

11. The doctor blade as claimed in claim 9, wherein said nub has one or more conductive additives, one of said conductive additives being lithium perchlorate.

12. The doctor blade as claimed in claim 1, wherein said nub has a volume resistivity of $2\times10^{7}$ Ohm-cm and a hardness of 51 shore a.

13. The doctor blade as claimed in claim 1, wherein said resilient member and said radiused nub are made of like material.

14. The doctor blade as claimed in claim 1, wherein said resilient member has at least one opening on a side which allows said resilient member to cantilever when in contact with said roll.

15. A doctor blade for metering electrophotographic toner held on a developer roll by physically contacting a sector of said roll with a surface of said blade which is electrically conductive, said blade comprising:

a member having a top edge, a bottom edge, a left edge and a right edge, said bottom edge being shorter than said left edge; and a nub extending from said member's bottom edge, said nub being electrically conductive.

16. The doctor blade of claim 15, further comprising an opening in said left edge.

17. The doctor blade of claim 15, wherein said nub has an arcuate surface.

18. The doctor blade of claim 15, wherein said member comprises a support portion and a resilient portion.

* * * * *